US010995694B2

(12) United States Patent
Sunada

(10) Patent No.: US 10,995,694 B2
(45) Date of Patent: May 4, 2021

(54) CYLINDER BLOCK

(71) Applicant: TOYOTA JIDOSHA KABUSHIKI KAISHA, Toyota (JP)

(72) Inventor: Hirotaka Sunada, Nagoya (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 16/785,723

(22) Filed: Feb. 10, 2020

(65) Prior Publication Data

US 2020/0284218 A1 Sep. 10, 2020

(30) Foreign Application Priority Data

Mar. 4, 2019 (JP) ..... JP2019-038294

(51) Int. Cl.

| | |
|---|---|
| ***F02F 1/16*** | (2006.01) |
| ***F02F 7/00*** | (2006.01) |
| ***F02F 1/24*** | (2006.01) |
| *F02F 1/10* | (2006.01) |

(52) U.S. Cl.

CPC ..... *F02F 1/16* (2013.01); *F02F 1/24* (2013.01); *F02F 7/0021* (2013.01); *F02F 2001/104* (2013.01)

(58) Field of Classification Search

CPC .... F02F 1/16; F02F 1/24; F02F 7/0021; F02F 2001/104; F02F 1/14

See application file for complete search history.

(56) References Cited

U.S. PATENT DOCUMENTS

| | | | | |
|---|---|---|---|---|
| 4,461,247 A * | 7/1984 | Hayashi | F02F 1/108 123/195 R |
| 5,253,615 A * | 10/1993 | Heater | F02F 1/108 123/195 R |
| 10,323,565 B2 * | 6/2019 | Matsushita | F01P 7/16 |
| 2017/0314502 A1 | 11/2017 | Suzuki et al. | |
| 2018/0094568 A1 * | 4/2018 | Yanagi | F01P 3/02 |

FOREIGN PATENT DOCUMENTS

| | | |
|---|---|---|
| JP | 05-027255 U | 4/1993 |
| JP | 11-193746 | * 7/1999 |
| JP | 2011-163215 A | 8/2011 |
| JP | 2017-198174 A | 11/2017 |

* cited by examiner

*Primary Examiner* — Phutthiwat Wongwian
*Assistant Examiner* — Diem T Tran
(74) *Attorney, Agent, or Firm* — Sughrue Mion, PLLC

(57) ABSTRACT

A cylinder block defines a cylinder, in which a piston is reciprocated. The cylinder includes an upper bore, a center bore, and a lower bore arranged in order from proximity to a cylinder head in the axial direction of the cylinder. The inner diameter of the center bore is greater than the inner diameters of the upper bore and the lower bore. The cylinder block defines an upper recess that serves as an upper water jacket surrounding the upper bore and a lower recess that serves as a lower water jacket surrounding the lower bore. The upper recess and the lower recess are spaced apart from each other in the axial direction of the cylinder so as to sandwich a spacer.

5 Claims, 2 Drawing Sheets

CYLINDER BLOCK

BACKGROUND

1. Field

The present disclosure relates to a cylinder block.

2. Description of Related Art

Japanese Laid-Open Patent Publication No. 2017-198174 describes a cylinder block for an internal combustion engine. Cylinders where pistons reciprocate are defined in the cylinder block. The cylinders described in the publication each have an upper bore, a center bore, and a lower bore arranged in order in the axial direction of the cylinder. The inner diameter of the center bore is greater than the inner diameters of the upper bore and the lower bore. A cylinder head covering the upper portions of the cylinders is fixed to the upper surface of the cylinder block. In the internal combustion engine described in the publication, an inner wall surface of the cylinder in the cylinder block, the upper surface of the piston, and the lower surface of the cylinder head define a combustion chamber, where fuel is burned.

In the above structure, the cylinder block has different temperatures depending on locations when the internal combustion engine is in operation and fuel is burned. Thus, the cylinder defined in the cylinder block has different amounts of expansion depending on locations. This may change the relationship of the inner diameters of the upper bore, the center bore, and the lower bore.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In one general aspect, a cylinder block that includes a cylinder, in which a piston is reciprocated, and a water jacket, through which coolant flows is provided. The cylinder includes an upper bore, a center bore that is connected to the upper bore and has an inner diameter that is greater than an inner diameter of the upper bore, and a lower bore that is connected to the center bore and has an inner diameter that is less than the inner diameter of the center bore. The upper bore, the center bore, and the lower bore are arranged in order in an axial direction of the cylinder from proximity to a cylinder head fixed to the cylinder block. The water jacket includes an upper water jacket that surrounds the upper bore at an outer side in a radial direction of the cylinder, and a lower water jacket that surrounds the lower bore at the outer side in the radial direction of the cylinder. The upper water jacket and the lower water jacket are spaced apart from each other in the axial direction of the cylinder so as to sandwich a non-formation area in which the water jacket is not formed.

Other features and aspects will be apparent from the following detailed description, the drawings, and the claims.

BRIEF DESCRIPTION OF THE DRAWINGS

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

This description provides a comprehensive understanding of the methods, apparatuses, and/or systems described. Modifications and equivalents of the methods, apparatuses, and/or systems described are apparent to one of ordinary skill in the art. Sequences of operations are exemplary, and may be changed as apparent to one of ordinary skill in the art, with the exception of operations necessarily occurring in a certain order. Descriptions of functions and constructions that are well known to one of ordinary skill in the art may be omitted.

Exemplary embodiments may have different forms, and are not limited to the examples described. However, the examples described are thorough and complete, and convey the full scope of the disclosure to one of ordinary skill in the art.

A cylinder block according to one embodiment of the present invention will now be described with reference to FIGS. 1 and 2. In the present embodiment, an internal combustion engine 100 is installed in a vehicle. The vertical direction of the vehicle refers to the vertical direction of the internal combustion engine 100.

The overall structure of the internal combustion engine 100 will be described.

Figure 1:
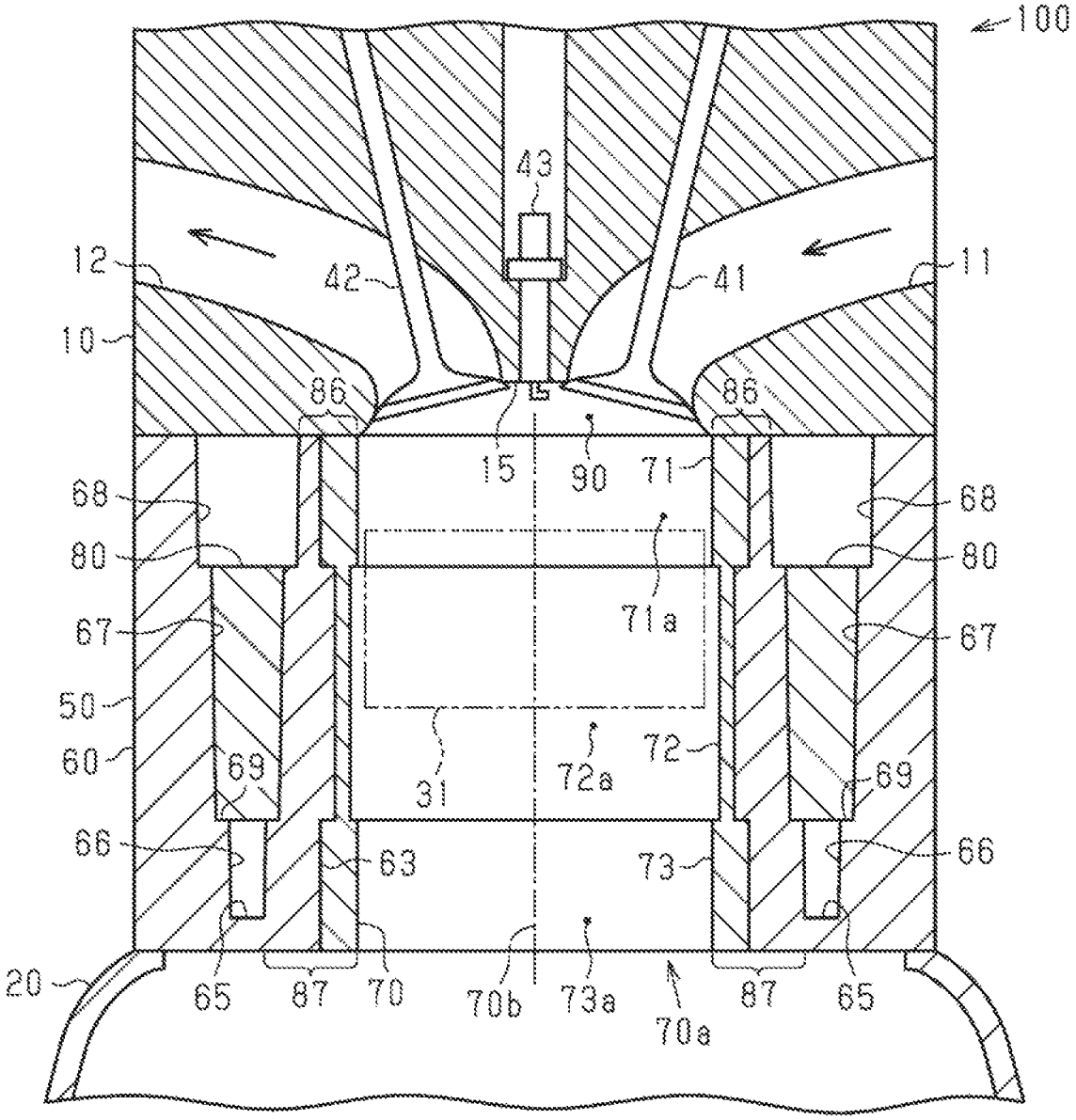
FIG. 1 is a cross-sectional view of an internal combustion engine.
Figure 2:
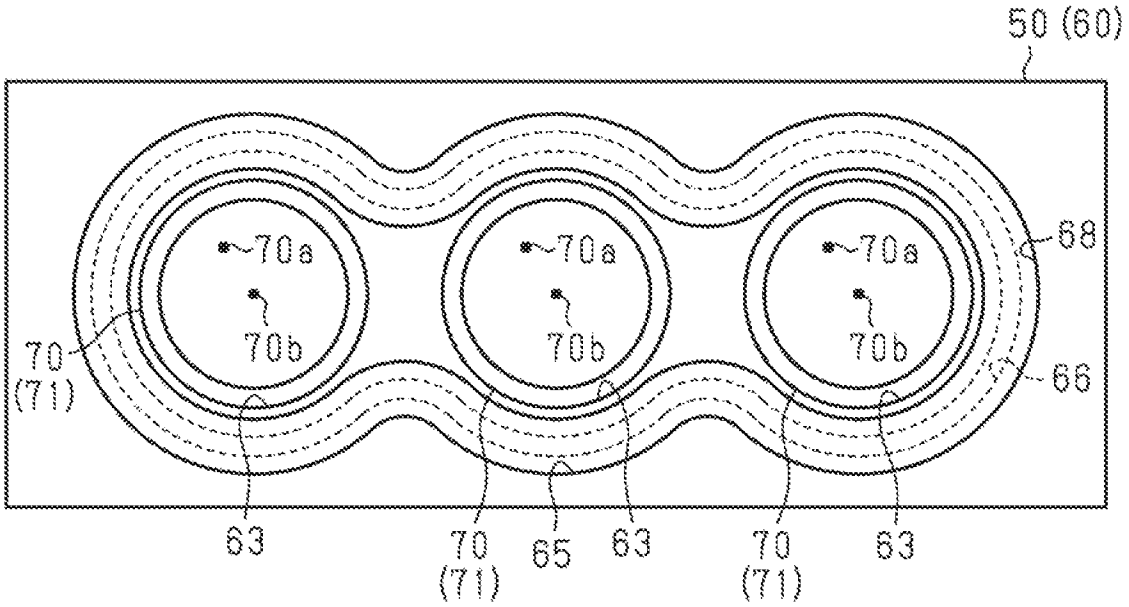
FIG. 2 is a top view of a cylinder block.

As shown in FIG. 1, the internal combustion engine 100 includes a cylinder block 50, which has a rectangular parallelepiped shape in its entirety. As shown in FIG. 2, three cylinders 70*a*, each having a substantially cylindrical shape, are defined inside the cylinder block 50. The cylinders 70*a* each extend through the cylinder block 50 from the upper surface to the lower surface of the cylinder block 50. The three cylinders 70*a* are arranged in the axial direction of a crankshaft (not shown).

As shown in FIG. 1, each cylinder 70*a* accommodates a piston 31, which has a cylindrical shape in its entirety. The piston 31 reciprocates in the axial direction of the cylinder 70*a* inside the cylinder 70*a*. The piston 31 is connected to the crankshaft via a connecting rod (not shown). In FIG. 1, the piston 31 is shown by the long dashed double-short dashed line.

A cylinder head 10, which has a rectangular parallelepiped shape in its entirety, is fixed to the upper surface of the cylinder block 50. The cylinder head 10 includes lower surface recesses 15 on the lower surface. In each lower surface recess 15, the lower surface of the cylinder head 10 is recessed upward. The lower surface recess 15 is substantially circular when viewed in the axial direction of the cylinder 70*a*. The lower surface recess 15 is arranged to face the corresponding cylinder 70*a*. An inner wall surface of the lower surface recess 15, an inner wall surface of the cylinder 70*a*, and the upper surface of the piston 31 define a combustion chamber 90.

Intake ports 11, through which intake air is drawn into the combustion chambers 90, are defined inside the cylinder head 10. Each intake port 11 extends from the upper portion of the combustion chamber 90 in a direction that is orthogonal to both of the directions in which the cylinders 70*a* are arranged and the vertical direction, namely, rightward in FIG. 1. The number of the intake ports 11 is three in conformance with the number of the cylinders 70*a*. Intake valves 41 are attached to the cylinder head 10 so as to open and close the openings of the intake ports 11, which are connected to the combustion chambers 90. The intake valves 41 are operated by a valve actuation mechanism (not shown). The intake valves 41 open and close the openings of the intake ports 11 in cooperation with rotation of the crankshaft.

Exhaust ports 12, through which exhaust gas is discharged from the combustion chambers 90, are defined inside the cylinder head 10. Each exhaust port 12 extends from the upper portion of the combustion chamber 90 to the opposite side from the intake port 11, namely, leftward in FIG. 1. Central axis 70*b* of each cylinder 70*a* lies between the exhaust port 12 and the intake port 11. The number of the exhaust ports 12 is three in conformance with the number of the cylinders 70*a*. Exhaust valves 42 are attached to the cylinder head 10 so as to open and close the openings of the exhaust ports 12, which are connected to the combustion chambers 90. The exhaust valves 42 are operated by a valve actuation mechanism (not shown). The exhaust valves 42 open and close the openings of the exhaust ports 12 in cooperation with rotation of the crankshaft.

A spark plug 43 that ignites fuel is attached to each of the cylinders 70*a* to be arranged between each intake port 11 and the corresponding exhaust port 12 of the cylinder head 10.

A fuel injection valve (not shown) injects fuel into each intake port 11. The fuel injected from the fuel injection valve is mixed with intake air, which flows inside the intake port 11, and is then drawn into the combustion chamber 90. The air-fuel mixture drawn into the combustion chamber 90 is ignited by the spark plug 43 and burned. The air-fuel mixture burned in the combustion chamber 90 becomes exhaust gas and is discharged to the exhaust port 12.

A crankcase 20 is fixed to the lower surface of the cylinder block 50. The crankcase 20 has a box shape in its entirety. The crankshaft is rotationally supported by the crankcase 20. An oil pan that stores oil is fixed to the lower portion of the crankcase 20.

The structure of the cylinder block 50 will be specifically described.

As shown in FIG. 1, the cylinder block 50 includes a block body 60, which has a rectangular parallelepiped shape in its entirety. Through holes 63 having a substantially circular cross section extend through the block body 60 in the vertical direction. Each through hole 63 extends from the upper surface to the lower surface of the block body 60. The central axis of the through hole 63 is coaxial with the central axis 70*b* of the cylinder 70*a*. The number of the through holes 63 is three in conformance with the number of the cylinders 70*a*. The material of the block body 60 is an aluminum alloy.

A liner 70 having a substantially tubular shape is fixed to the inner surface of each through hole 63. The central axis of liner 70 is coaxial with the central axis 70*b* of the cylinder 70*a*. The length of the liner 70 in the axial direction is the same as the length of the cylinder 70*a* in the axial direction. The liner 70 forms the inner wall surface of the cylinder 70*a*. The material of the liner 70 is cast iron. Thus, the material of the liner 70 has a linear expansion coefficient that is less than the linear expansion coefficient of the material of the block body 60.

The liner 70 includes an upper wall 71, a center wall 72, and a lower wall 73 arranged in order from above in the axial direction of the cylinder 70*a*. The inner diameter of the center wall 72 is slightly greater than the inner diameters of the upper wall 71 and the lower wall 73. The outer diameter of the center wall 72 is less than the outer diameters of the upper wall 71 and the lower wall 73. Thus, the thickness of the center wall 72 is less than the thicknesses of the upper wall 71 and the lower wall 73. The inner diameters of the upper wall 71 and the lower wall 73 are the same. The outer diameters of the upper wall 71 and the lower wall 73 are the same.

The upper wall 71, the center wall 72, and the lower wall 73 form inner wall surfaces of an upper bore 71*a*, a center bore 72*a*, and a lower bore 73*a* of the cylinder 70*a*. Thus, the inner diameter of the center bore 72*a* is greater than the inner diameters of the upper bore 71*a* and the lower bore 73*a*. In FIG. 1, the difference between the inner diameter of the center bore 72*a* and the inner diameters of the upper bore 71*a* and the lower bore 73*a* is exaggerated.

The block body 60 includes a recess 65 on the upper surface. In the recess 65, the upper surface of the block body 60 is recessed downward. That is, as shown in FIG. 1, when the block body 60 is viewed in the cross section including the central axis 70*b* of the cylinder 70*a*, the recess 65 is a recess extending downward from the upper surface of the block body 60 in parallel with central axis 70*b* of the cylinder 70*a*. The bottom surface of the recess 65 is located near the lower end surface of the block body 60. In other words, the recess 65 is recessed from substantially the entire area of the block body 60 in the axial direction of the cylinders 70*a* without extending through the block body 60. As shown in FIG. 2, the recess 65 surrounds all of the three cylinders 70*a* at an outer side of the cylinders 70*a* and has a substantially constant width in proximity to the upper surface of the block body 60.

As shown in FIG. 1, the recess 65 includes a lower recess 66, a center recess 67, and an upper recess 68 arranged in order from the bottom of the recess 65. The lower recess 66 extends from the bottom surface of the recess 65 to a location that has the same height as the upper ends of the lower bores 73*a* in the axial direction of the cylinders 70*a*. The lower recess 66 surrounds the lower bores 73*a* at the outer side in the radial direction of the cylinders 70*a*. The width of the lower recess 66 increases from the lower portion to the upper portion. In the present embodiment, the lower recess 66 is the first recess.

The center recess 67 extends upward from the upper end of the lower recess 66. The center recess 67 extends from the lower ends of the center bores 72*a* to a location that has the same height as the upper ends of the center bores 72*a* in the axial direction of the cylinders 70*a*. The center recess 67 surrounds the center bores 72*a* at the outer side in the radial direction of the cylinders 70*a*. The width of the center recess 67 increases from the lower portion to the upper portion. The width of the lower end of the center recess 67 is greater than the width of the upper end of the lower recess 66. This forms a step 69 between the upper end of the lower recess 66 and the lower end of the center recess 67.

The upper recess 68 extends upward from the upper end of the center recess 67. The upper recess 68 extends from the lower ends of the upper bores 71*a* to the upper surface of the block body 60 in the axial direction of the cylinders 70*a*. The upper recess 68 surrounds the upper bores 71*a* at the outer side in the radial direction of the cylinders 70*a*. The width of the upper recess 68 increases from the lower portion to the upper portion. The width of the lower end of the upper recess 68 is greater than the width of the upper end of the center recess 67. Further, as shown in FIG. 1, when viewed in the cross section including the central axis 70*b* of the cylinder 70*a*, the cross-sectional area of the upper recess 68 is greater than the cross-sectional area of the lower recess 66. In the present embodiment, the center recess 67 and the upper recess 68 are the second recess.

A spacer 80 that fills an internal space of the center recess 67 is arranged in the center recess 67. The spacer 80 has a shape that corresponds to the space of the center recess 67. The lower end of the spacer 80 abuts the step 69 in the recess 65. Thus, the spacer 80 defines the upper recess 68 and the lower recess 66 in an internal space of the recess 65. The upper recess 68 serves as an upper water jacket through which coolant flows. The lower recess 66 serves as a lower water jacket through which coolant flows. The coolant flowing through the upper recess 68 and the lower recess 66 is drawn into the upper recess 68 and the lower recess 66 via coolant intake passages (not shown). The coolant that has flowed through the upper recess 68 and the lower recess 66 is discharged from the upper recess 68 and the lower recess 66 via coolant discharge passages (not shown).

As described above, when viewed in the cross section including the central axis 70*b* of each cylinder 70*a*, the cross-sectional area of the upper recess 68 is greater than the cross-sectional area of the lower recess 66. Thus, when viewed in the cross section including the central axis 70*b* of the cylinder 70*a*, the cross-sectional passage area of the upper water jacket is greater than the cross-sectional passage area of the lower water jacket. The upper water jacket and the lower water jacket are spaced apart from each other in the axial direction of the cylinders 70*a* so as to sandwich the spacer 80 that forms a non-formation area in which a water jacket is not formed.

As described above, the width of the upper recess 68 is greater than the width of the lower recess 66. Thus, the average thickness of an upper partition wall 86 that separates the upper water jacket and the upper bore 71*a* of the cylinder 70*a* from each other is less than the average thickness of a lower partition wall 87 that separates the lower water jacket and the lower bore 73*a* of the cylinder 70*a* from each other. The average thickness refers to an average value of the thickness in the entire area in which the upper partition wall 86 or the lower partition wall 87 is arranged.

A method for manufacturing the cylinder block 50 will be described.

The block body 60 is manufactured through die casting, which is a type of casting. The casting step uses a first die arranged for the upper portion of the block body 60 and a second die arranged for the lower portion of the block body 60. The first die is shaped in conformance with the shape of the upper portion of the block body 60. Specifically, the first die includes a projection that is formed in conformance with the shape of the recess 65. The second die is shaped in conformance with the shape of the lower portion of the block body 60. The liner 70 molded in advance is arranged at a predetermined location in the space between the first die and the second die. A molten aluminum alloy is cast into the space at high pressure between the first die and the second die. Then, the metal solidified in the space between the first die and the second die is obtained when the first die and the second die are removed. In the casting step, the liner 70 is formed integrally with the block body 60.

The operation and advantages of the present embodiment will now be described.

(1) The spacer 80 is arranged in the center recess 67 so that the center recess 67 does not serve as a water jacket. Accordingly, the inner wall surface of the center bore 72*a* of each cylinder 70*a* adjacent to the spacer 80 is less likely to be cooled by coolant. Thus, when the internal combustion engine 100 is in operation, the temperature of the center bore 72*a* is higher and the amount of expansion of the inner diameter of the center bore 72*a* is relatively great.

The upper recess 68 and the lower recess 66 serve as the upper water jacket and the lower water jacket through which coolant flows. Accordingly, the inner wall surfaces of the upper bore 71*a* and the lower bore 73*a* adjacent to the upper water jacket and the lower water jacket are likely to be cooled through heat exchange with coolant flowing through the upper water jacket and the lower water jacket. Thus, when the internal combustion engine 100 is in operation, the temperatures of the inner wall surfaces of the upper bore 71*a* and the lower bore 73*a* are less likely to be higher than the temperature of the inner wall surface of the center bore 72*a*. As a result, the amounts of expansion of the inner diameters of the upper bore 71*a* and the lower bore 73*a* are less than the amount of expansion of the inner diameter of the center bore 72*a*. That is, while the amount of expansion of the inner diameter of the center bore 72*a* is less likely to be restricted, the amounts of expansion of the inner diameters of the upper bore 71*a* and the lower bore 73*a* are effectively restricted. This maintains the relationship that the inner diameter of the center bore 72*a* is greater than the inner diameters of the upper bore 71*a* and the lower bore 73*a* when the internal combustion engine 100 is in operation.

(2) When the internal combustion engine 100 is in operation, the heat of burned fuel is generally transmitted from the upper portion to the lower portion of the cylinder block 50. Thus, the temperature of the inner wall surface of the upper bore 71*a* is likely to be higher than the temperature of the inner wall surface of the lower bore 73*a*.

When viewed in the cross section including the central axis 70*b* of the cylinder 70*a*, the cross-sectional area of the upper water jacket is greater than the cross-sectional area of the lower water jacket. Thus, the amount of coolant flowing through the upper water jacket is greater than the amount of coolant flowing through the lower water jacket. Further, the average thickness of the upper partition wall 86 that separates the upper water jacket and the upper bore 71*a* of the cylinder 70*a* from each other is less than the average thickness of the lower partition wall 87 that separates the lower water jacket and the lower bore 73*a* of the cylinder 70*a* from each other. That is, the upper water jacket is closer to the cylinder 70*a* than the lower water jacket. This more efficiently cools the inner wall surface of the upper bore 71*a*, of which the temperature is likely to be higher from the heat of burned fuel.

(3) The upper recess 68 extends from the lower ends of the upper bores 71*a* to the upper surface of the block body 60 in the axial direction of the cylinders 70*a*. That is, the upper bores 71*a* of the cylinders 70*a* are surrounded by the upper water jacket, through which coolant flows, in the entire range of the upper bores 71*a* in the axial direction. Accordingly, the inner wall surface of each upper bore 71*a* is cooled by coolant flowing through the upper water jacket in the entire range of the upper bore 71*a* in the axial direction. This restricts expansion of the inner diameter of the upper bore 71*a* in the entire range of the upper bore 71*a* in the axial direction.

(4) The liners 70 made of cast iron are fixed to the block body 60 made of an aluminum alloy. The liners 70 made of cast iron as well as the block body 60 made of an aluminum alloy affect the amounts of thermal expansion of the inner diameters of the upper bores 71*a*, the center bores 72*a*, and the lower bores 73*a* of the cylinders 70*a*. In the present embodiment, the thicknesses of the upper wall 71 and the lower wall 73 of each liner 70 are greater than the thickness of the center wall 72 of the liner 70. Thus, the amounts of expansion of the inner diameters of the upper bore 71*a* and the lower bore 73*a* of the cylinder 70*a* are more likely to be affected by the liner 70, which is made of cast iron, than the center bore 72*a*. That is, the inner diameters of the upper bore 71*a* and the lower bore 73*a* are less likely to expand because of the liner 70, which is made of cast iron with a smaller linear expansion coefficient. In contrast, the amount of expansion of the inner diameter of the center bore 72*a* is more likely to be affected by the block body 60, which is made of aluminum alloy, than the upper bore 71*a* and the lower bore 73*a*. That is, the inner diameter of the center bore 72*a* of the cylinder 70*a* is likely to expand because of the block body 60, which is made of aluminum alloy with a greater linear expansion coefficient. This is likely to reduce the amounts of expansion of the inner diameters of the upper bore 71*a* and the lower bore 73*a* from the amount of expansion of the inner diameter of the center bore 72*a*.

(5) If the upper water jacket and the lower water jacket of the block body 60 are separately formed by casting, this will add a step of forming sand cores for forming the upper water jacket and the lower water jacket and complicate the casting step by arranging the cores.

In the present embodiment, the simple structure of arranging the spacer 80 in the center recess 67 of the recess 65 defines the upper water jacket and the lower water jacket in the internal space of the recess 65. This does not add a step when manufacturing the block body 60 nor complicate the step of manufacturing the block body 60. Thus, the cylinder block 50 is manufactured by a step that is easier than separately forming the upper water jacket and the lower water jacket of the block body 60.

(6) The spacer 80 arranged in the center recess 67 of the recess 65 is in abutment with the step 69. That is, as the spacer 80 abuts the step 69, the spacer 80 is located inside the center recess 67 in the axial direction of the cylinders 70*a*. Thus, when the cylinder block 50 is manufactured, the spacer 80 is securely arranged at a predetermined location inside the center recess 67. This reduces problems such as a change in the shapes or the cross-sectional areas of the upper water jacket and the lower water jacket when the spacer 80 is not arranged at the predetermined location inside the center recess 67.

(7) In the casting step of the block body 60, when the first die is removed from the metal solidified in the space between the first die and the second die, the projection of the first die is removed from the recess 65 of the block body 60. In the present embodiment, the widths of the lower recess 66, the center recess 67, and the upper recess 68 of the recess 65 increase as the lower recess 66, the center recess 67, and the upper recess 68 extend upward. Thus, when the first die is moved along the central axis 70*b* of the cylinder 70*a* so as to remove the first die from the block body 60, the inner wall surface of the recess 65 of the block body 60 is less likely to interfere with the outer wall surface of the projection of the first die. That is, the cylinder block 50 is easily manufactured with the dies.

The present embodiment may be modified as described below. The present embodiment and the following modification can be combined as long as the combined modifications are not in contradiction.

In the above embodiment, the shape of the recess 65 may be changed. When viewed in a cross section including the central axis 70*b* of the cylinder 70*a*, the cross-sectional area of the upper recess 68 may be the same as or less than the cross-sectional area of the lower recess 66.

In the axial direction of the cylinders 70*a*, the lower end of the upper recess 68 may be located downward from the lower ends of the upper bores 71*a* or upward from the lower ends of the upper bores 71*a*. In this case, the center bores 72*a* are less likely to be cooled than the upper bores 71*a* and thus the inner diameters of the center bores 72*a* are likely to expand as long as the upper recess 68 and the lower recess 66, through which coolant flows, are spaced apart from each other in the axial direction of the cylinders 70*a*. Likewise, the upper end of the lower recess 66 may be located upward from the upper ends of the lower bores 73*a* or downward from the upper ends of the lower bores 73*a*.

Further, the width of the upper recess 68 may be constant in the axial direction of the cylinders 70*a*. Likewise, the widths of the center recess 67 and the lower recess 66 may be constant in the axial direction of the cylinders 70*a*.

Further, the width of the lower end of the center recess 67 may be the same as the width of the upper end of the lower recess 66. That is, the step 69 between the upper end of the lower recess 66 and the lower end of the center recess 67 may be removed.

The shape of the spacer 80 may be changed. The spacer may include a body shaped in conformance with the space of the center recess 67 and a leg projecting downward from the lower surface of the body. When the leg of the spacer abuts the bottom surface of the lower recess 66, the body of the spacer is arranged in the center recess 67 of the recess 65. Further, if the size of the leg of the spacer is less than the width of the lower recess 66, the lower recess 66 serves as the lower water jacket.

The thickness of the wall that separates the cylinder 70*a* and the recess 65 from each other may be changed. The average thickness of the upper partition wall 86 may be the same or greater than the average thickness of the lower partition wall 87.

The shape of the liner 70 may be changed. The outer diameter of the center wall 72 may be the same or greater than the outer diameters of the upper wall 71 and the lower wall 73. The thickness of the center wall 72 may be the same or greater than the thicknesses of the upper wall 71 and the lower wall 73.

The inner diameter of the upper wall 71 may be greater than or less than the inner diameter of the lower wall 73. The outer diameter of the upper wall 71 may be greater than or less than the outer diameter of the lower wall 73.

The materials of the block body 60 and the liner 70 may be changed. The material of the block body 60 may be cast iron, and the material of the liner 70 may be an aluminum alloy. That is, the linear expansion coefficient of the material of the liner 70 may be the same or greater than the linear expansion coefficient of the material of the block body 60. Further, the block body 60 and the liner 70 may be made of the same material.

The number of the cylinders 70*a* of the cylinder block 50 may be changed. Two cylinders 70*a* or less or four cylinders 70*a* or more may be defined inside the cylinder block 50.

The method for manufacturing the cylinder block 50 may be changed. The cylinder block 50 may be manufactured through, for example, sand casting, which is a type of casting.

The upper water jacket and the lower water jacket may be separately formed in the block body 60. When the block body 60 is casted, a sand core formed in advance may be arranged in the space between the first die and the second die so as to separately form the upper water jacket and the lower water jacket.

Various changes in form and details may be made to the examples above without departing from the spirit and scope of the claims and their equivalents. The examples are for the sake of description only, and not for purposes of limitation. Descriptions of features in each example are to be considered as being applicable to similar features or aspects in other examples. Suitable results may be achieved if sequences are performed in a different order, and/or if components in a described system, architecture, device, or circuit are combined differently, and/or replaced or supplemented by other components or their equivalents. The scope of the disclosure is not defined by the detailed description, but by the claims and their equivalents. All variations within the scope of the claims and their equivalents are included in the disclosure.

What is claimed is:

1. A cylinder block comprising:

a cylinder, in which a piston is configured to reciprocate; and a water jacket, through which a liquid coolant is configured to flow, wherein the cylinder comprises:

an upper bore, a center bore that is connected to the upper bore and has an inner diameter that is greater than an inner diameter of the upper bore, and a lower bore that is connected to the center bore and has an inner diameter that is less than the inner diameter of the center bore, the upper bore, the center bore, and the lower bore are arranged in order in an axial direction of the cylinder, the upper bore being nearest a cylinder head fixed to the cylinder block, the water jacket comprises:

an upper water jacket that surrounds the upper bore at an outer side in a radial direction of the cylinder, and a lower water jacket that surrounds the lower bore at the outer side in the radial direction of the cylinder, the upper water jacket and the lower water jacket are spaced apart from each other in the axial direction of the cylinder so as to sandwich a non-formation area in which the water jacket is not formed, and a length of the non-formation area in the axial direction of the cylinder corresponds to a length of the center bore in the axial direction of the cylinder, wherein when viewed in a cross section including a central axis of the cylinder, a cross-sectional passage area of the upper water jacket is greater than a cross-sectional passage area of the lower water jacket, and wherein an average thickness of an upper partition wall that separates the upper water jacket and the cylinder from each other is less than an average thickness of a lower partition wall that separates the lower water jacket and the cylinder form each other.

2. The cylinder block according to claim 1, wherein an end surface of the cylinder block to which the cylinder head is fixed includes a recess, the recess surrounds the upper bore, the center bore, and the lower bore at the outer side in the radial direction of the cylinder, the recess includes a spacer that forms the non-formation area, and the spacer defines the upper water jacket and the lower water jacket in an internal space of the recess.

3. The cylinder block according to claim 2, wherein the recess extends in the axial direction of the cylinder from the end surface of the cylinder block to which the cylinder head is fixed, and a width of the recess increases toward the end surface of the cylinder block to which the cylinder head is fixed.

4. A cylinder block comprising:

a cylinder, in which a piston is configured to reciprocate; and a water jacket, through which a liquid coolant is configured to flow, wherein the cylinder comprises:

an upper bore, a center bore that is connected to the upper bore and has an inner diameter that is greater than an inner diameter of the upper bore, and a lower bore that is connected to the center bore and has an inner diameter that is less than the inner diameter of the center bore, the upper bore, the center bore, and the lower bore are arranged in order in an axial direction of the cylinder, the upper bore being nearest a cylinder head fixed to the cylinder block, the water jacket comprises:

an upper water jacket that surrounds the upper bore at an outer side in a radial direction of the cylinder, and a lower water jacket that surrounds the lower bore at the outer side in the radial direction of the cylinder, the upper water jacket and the lower water jacket are spaced apart from each other in the axial direction of the cylinder so as to sandwich a non-formation area in which the water jacket is not formed, a length of the non-formation area in the axial direction of the cylinder corresponds to a length of the center bore in the axial direction of the cylinder, an end surface of the cylinder block to which the cylinder head is fixed includes a recess, the recess surrounds the upper bore, the center bore, and the lower bore at the outer side in the radial direction of the cylinder, the recess includes a spacer that forms the non-formation area, the spacer defines the upper water jacket and the lower water jacket in an internal space of the recess, the recess includes:

a first recess that surrounds the lower bore, and a second recess that extends from the first recess to the end surface of the cylinder block to which the cylinder head is fixed, a width of an end of the second recess nearest the first recess is greater than a width of an end of the first recess nearest the second recess, and the spacer abuts a step formed between the first recess and the second recess.

5. The cylinder block according to claim 1, comprising:

a block body including a cylindrical through hole; and a tubular liner that is fixed to an inner surface of the through hole and forms an inner wall surface of the cylinder, wherein a material of the liner has a linear expansion coefficient that is less than a linear expansion coefficient of a material of the block body, and a thickness of a portion of the liner that forms an inner wall surface of the upper bore and a thickness of a portion of the liner that forms an inner wall surface of the lower bore are greater than a thickness of a portion of the liner that forms an inner wall surface of the center bore.

* * * * *